United States Patent [19]

Konno

[11] Patent Number: 5,031,583

[45] Date of Patent: Jul. 16, 1991

[54] VALVE OPERATING DEVICE FOR INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 210,340

[22] Filed: Jun. 23, 1988

[30] Foreign Application Priority Data

Jun. 23, 1987 [JP] Japan ..... 62-155929

[51] Int. Cl.[5] ..... F01L 1/34

[52] U.S. Cl. ..... 123/90.16; 123/90.17

[58] Field of Search ..... 123/90.12, 90.13, 90.15, 123/90.17, 90.27, 90.31

[56] References Cited

U.S. PATENT DOCUMENTS

| | | | |
|---|---|---|---|
| 3,633,554 | 1/1972 | Nakajima et al. | 123/90.18 |
| 4,305,352 | 12/1981 | Oshima et al. | 123/90.15 |
| 4,494,495 | 1/1985 | Nakamura et al. | 123/90.15 |
| 4,494,496 | 1/1985 | Nakamura et al. | 123/90.15 |
| 4,498,431 | 2/1985 | Nakamura et al. | 123/90.15 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,561,390 | 12/1985 | Nakamura et al. | 123/90.15 |
| 4,576,128 | 3/1986 | Kenichi | 123/90.16 |
| 4,587,936 | 5/1986 | Matsuura et al. | 123/90.46 |
| 4,612,884 | 9/1986 | Ajiki et al. | 123/90.16 |
| 4,656,977 | 4/1987 | Nagahiro et al. | 123/90.16 |
| 4,690,110 | 9/1987 | Nishimura et al. | 123/90.17 |
| 4,759,322 | 7/1988 | Konno | 123/90.17 |
| 4,777,914 | 10/1988 | Konno | 123/90.17 |
| 4,787,345 | 11/1988 | Thoma | 123/90.15 |
| 4,788,946 | 12/1988 | Inoue et al. | 123/90.17 |
| 4,790,274 | 12/1988 | Inoue et al. | 123/90.17 |

*Primary Examiner*—Charles J. Myhre
*Assistant Examiner*—Weilun Lo

[57] ABSTRACT

A valve operating device for an internal combustion engine in which a selective coupling mechanism is operable to control the lift and opening interval of the valve includes a hydraulically operated phase adjusting mechanism disposed between the timing wheel and the camshaft to effect relative angular movement therebetween for timing control of valve operation.

4 Claims, 3 Drawing Sheets

FIG. 3.
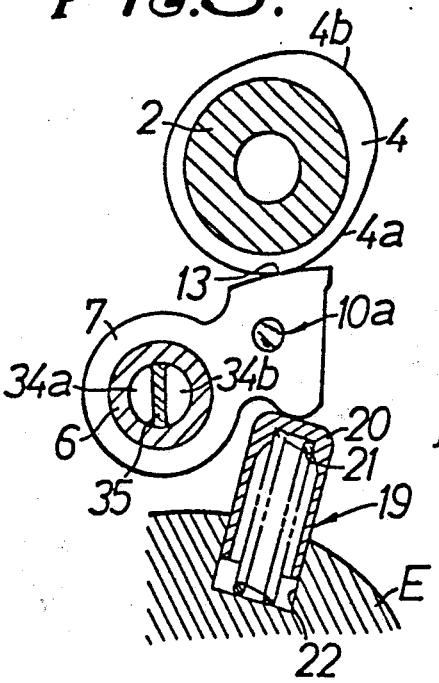
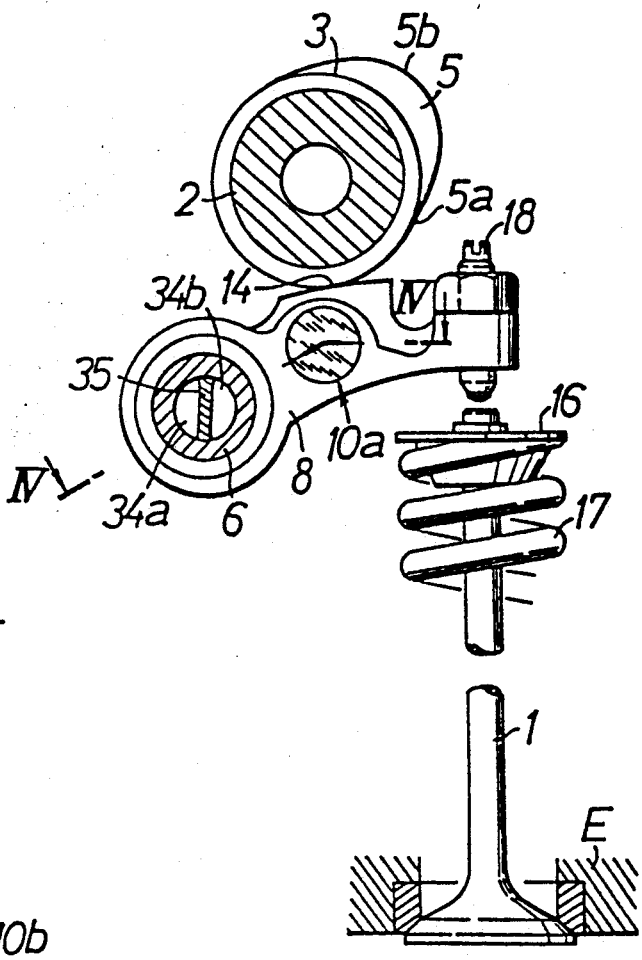
FIG. 2.
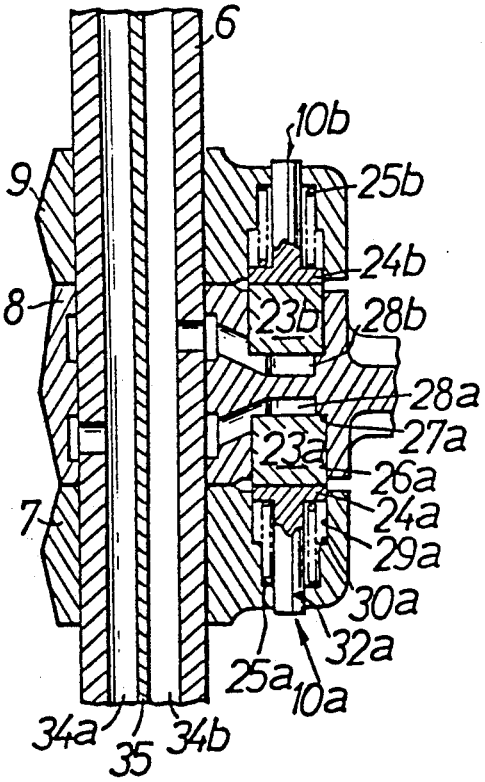
FIG. 4.

VALVE OPERATING DEVICE FOR INTERNAL COMBUSTION ENGINE

BACKGROUND OF THE INVENTION

The present invention relates to a valve operating device for an internal combustion engine, and, specifically, to a valve operating device wherein a camshaft having a plurality of cams of different profiles for operating an intake or an exhaust valve associated with an engine cylinder is operatively coupled to a timing wheel driveable by the crankshaft of the engine, and a selective coupling mechanism is disposed between a plurality of cam followers operable in response to rotation of the camshaft for selectively connecting the cam followers to control the operating mode of the intake or exhaust valve according to operating conditions of the engine.

One conventional valve operating device of the type described is known from Japanese Laid-Open Patent Publication No. 61-19911, for example. In such conventional valve operating device, the cam followers are selectively connected for operation by the respective cams for opening and closing the intake or exhaust valves, and thus control the lift of the respective intake or exhaust valves, that corresponds to the amount by which the cam lobe of each cam projects, and also control the opening interval of the intake or exhaust valve dependent on the angular interval of the cam lobe on each cam. To increase the accuracy of control of valve operation in internal combustion engines by such conventional devices the cam profiles are required to be greatly different from each other. In meeting this requirement, however, the selective coupling mechanism is subjected to great limitations and difficulty arises because of the number of cams required to be used and the large amount of space required to accommodate this number of cams.

SUMMARY OF THE INVENTION

The present invention has been made in view of the above drawbacks and it is, accordingly, an object of the present invention to provide a valve operating device for an internal combustion engine, which can control, not only the lift and opening interval of the intake or exhaust valve, but also the phase for advancing or retarding the timing at which the valve is opened or closed.

According to the present invention, a phase adjusting mechanism is disposed between the timing wheel and the camshaft for allowing relative angular movement between the timing wheel and the camshaft. With such an arrangement, the lift of the intake or the exhaust valve to open the valve and the opening interval thereof can be controlled by selectively connecting the cam followers with the selective coupling mechanism, and the timing at which the intake or exhaust valve is opened and closed can be controlled by turning the timing wheel with respect to the camshaft with the phase adjusting mechanism.

For a better understanding of the invention, its operating advantages and the specific objectives obtained by its use, reference should be made to the accompanying drawings and description which relate to a preferred embodiment thereof.

BRIEF DESCRIPTION OF THE DRAWINGS

FIG. 2 is a sectional view taken along line II—II of FIG. 1;

FIG. 3 is a sectional view taken along line III—III of FIG. 1;

FIG. 4 is a sectional view taken along line IV—IV of FIG. 2; and

DESCRIPTION OF A PREFERRED EMBODIMENT OF THE INVENTION

Figure 1:
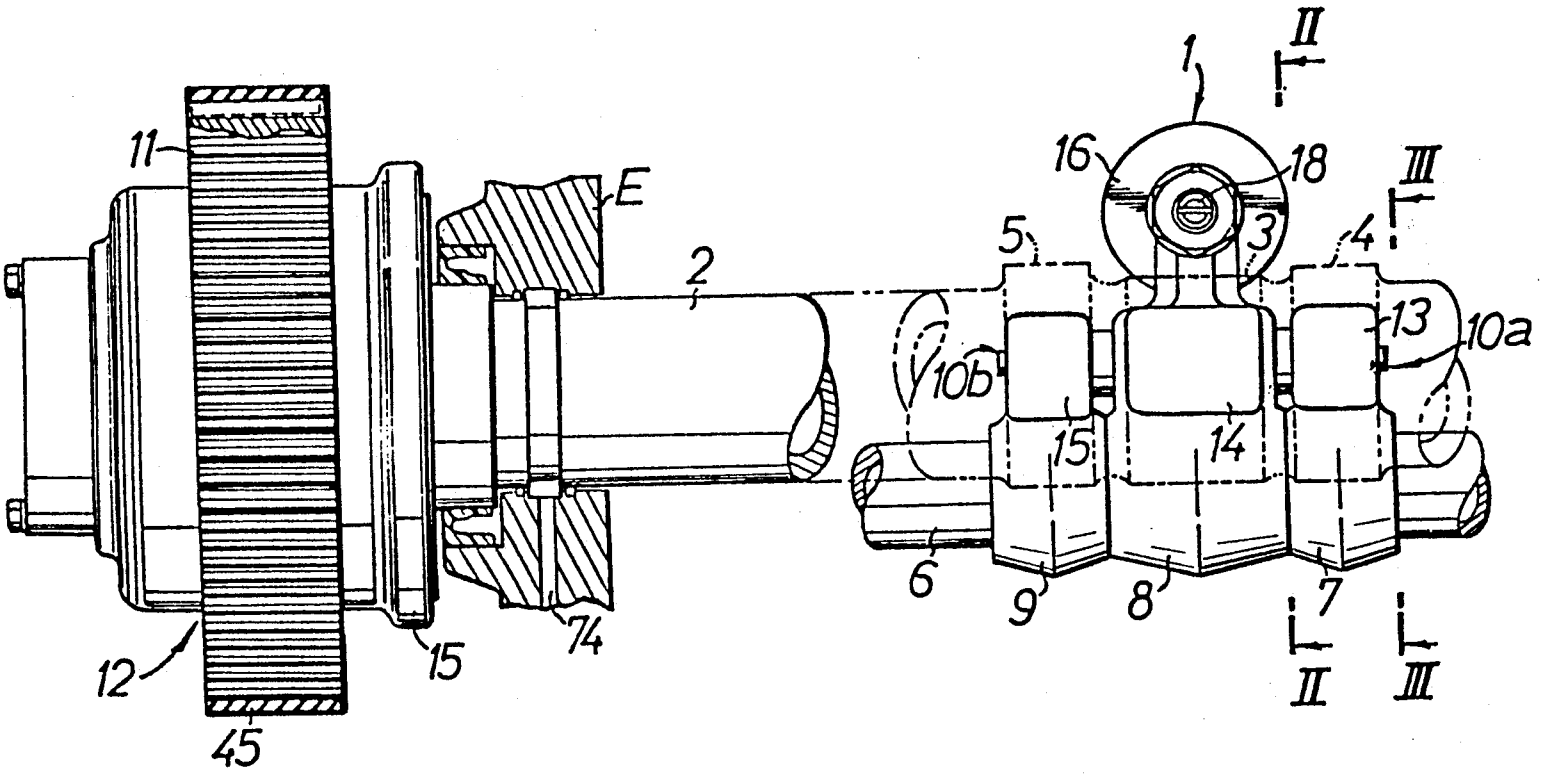
FIG. 1 is a plan view of valve operating apparatus according to the present invention.

An embodiment of the present invention, which is incorporated in a multicylinder internal combustion engine, is hereinafter described with reference to the drawings. In FIGS. 1 and 2, an intake valve 1 disposed in an engine body E for a certain cylinder is opened and closed by an annular raised portion 3, a low-speed cam 4, and a high-speed cam 5, which are integrally formed on a camshaft 2 that is rotatable by the crankshaft of the engine at a speed ratio of ½ with respect to the speed of rotation of the engine. The valve 1 is operated by the raised portion 3 and cams 4 and 5 through first, second, and third rocker arms 7, 8, 9 that are angularly movably supported on a rocker shaft 6 extending parallel to the camshaft 2. Selective coupling mechanisms 10*a*, 10*b* are disposed between the first and second rocker arms 7, 8 and the second and third rocker arms 8, 9, respectively, and a phase adjusting mechanism 12 is disposed between a timing wheel or pulley 11 operatively coupled between the crankshaft (not shown) and the camshaft 2.

The camshaft 2 is rotatably disposed above the engine body E. The low-speed cam 4, the raised portion 3, and the high-speed cam 5 are axially successively arranged in adjacent relation and integrally formed on the camshaft 2. The raised portion 3 is of a circular shape coaxial with the camshaft 2. The low-speed cam 4 includes a base circle portion 4*a* coaxial with the camshaft 2 and a cam lobe 4*b* projecting radially outwardly from the base circle portion 4*a*. The high-speed cam 5 includes a base circle portion 5*a* coaxial with the camshaft 2 and a cam lobe 5*b* projecting radially outwardly from the base circle portion 5*a*. The cam lobe 5*b* projects a greater distance and has a greater angular interval than the cam lobe 4*b*.

The rocker shaft 6 is fixedly positioned below the camshaft 2. The first rocker arm 7 having on its upper surface a cam slipper 13 held in slidable contact with the low-speed cam 4, the second rocker arm 8 having on its upper surface a cam slipper 14 held in slidable contact with the raised portion 3, and the third rocker arm 9 having on its upper surface a ca slipper 15 held in slidable contact with the high-speed cam 5, are pivotally supported on the rocker shaft 6 in axially adjacent relation.

The intake valve 1 is operatively associated with the second rocker arm 8. A flange 16 is attached to the upper end of the intake valve 1. The intake valve 1 is normally urged in a closing direction, i.e., upwardly, by a valve spring 17 disposed between the flange 16 and the engine body E. A tappet screw 18 is adjustably threaded in the distal end of the second rocker arm 8 in abutting engagement with the upper end of the intake valve 1.

As shown in FIG. 3, the first rocker arm 7 is normally urged resiliently in a direction to slidably contact the low-speed cam 4 by resilient urging means 19 disposed between the rocker arm and the engine body E. The third rocker arm 9 is similarly resiliently urged to slidably contact the high-speed cam 5. The resilient urging means 19 each comprise a cylindrical bottomed lifter 20 with its closed end held against the lower surface of the first and third rocker arms 7, 9, respectively, and a spring 21 disposed between the lifter 20 and the engine body E. Each lifter 20 is slidably fitted in a bottomed hole 22 defined in the engine body E.

As shown in FIG. 4, the selective coupling mechanism 10*a* comprises a coupling pin 23*a*, movable between a position in which the first and second rocker arms 7, 8 are connected, and a position in which they are disconnected; a stopper 24*a* for limiting the movement of the coupling pin 23*a*; and a return spring 25*a* for urging the coupling pin 23*a* in a direction to disconnect the rocker arms 7, 8.

The second rocker arm 8 has a bottomed guide hole 26*a* opening toward the first rocker arm 7 and parallel to the rocker shaft 6, with a step 27*a* being defined near the closed end of the hole 26*a* and facing toward the open end thereof. The coupling pin 23*a* is slidably fitted in the first guide hole 26*a*, with a hydraulic chamber 28*a* being defined between the coupling pin 23*a* and the closed end of the first guide hole 26*a*.

The first rocker arm 7 has a second bottomed guide hole 29*a* opening toward the second rocker arm 8 and parallel to the rocker shaft 6 for registration with the first guide hole 26*a*. A disc-shaped stopper 24*a* is slidably fitted in the second guide hole 29*a*. A limiting step 30*a* is defined near the closed end of the second guide hole 29*a* and faces toward the open end thereof. An insertion hole 32*a* is also defined at the closed end of the second guide hole 29*a* coaxially therewith. A guide rod 33*a* coaxial and integral with the stopper 24*a* extends through the insertion hole 32*a*. A return coil spring 25*a* is disposed between the stopper 24*a* and the closed end of the second guide hole 29*a* and the guide rod 33*a*.

The coupling pin 23*a* has such an axial length that, when one end thereof abuts against the step 27*a*, the other end thereof is positioned between the first and second rocker arms 7, 8, and when the coupling pin 23*a* enters the second guide hole 29*a* to the extent that the stopper 24*a* abuts against the limiting step 30*a*, said one end of the coupling pin 23*a* remains positioned in the first guide hole 26*a*.

The rocker shaft has an interior hollow space divided into two oil passages 34*a*, 34*b* by an axially extending partition 35. The oil passages 34*a*, 34*b* are selectively supplied with hydraulic pressure from a hydraulic pressure supply source (not shown). The oil passage 34*a* is maintained in communication with the hydraulic chamber 28*a* at all times irrespective of how the second rocker arm may be angularly moved.

The selective coupling mechanism 10*b* disposed between the second and third rocker arms 8, 9 is basically of the same construction as that of the selective coupling mechanism 10*a*, the selective coupling mechanism 10*b* having a coupling pin 23*b*, a stopper 24*b*, and a return spring 25*b*. The selective coupling mechanism 10*b* includes a hydraulic chamber 28*b* which is maintained in communication with the oil passage 34*b* in the rocker shaft 6 irrespective of how the second rocker arm 8 may be angularly moved.

Figure 5:
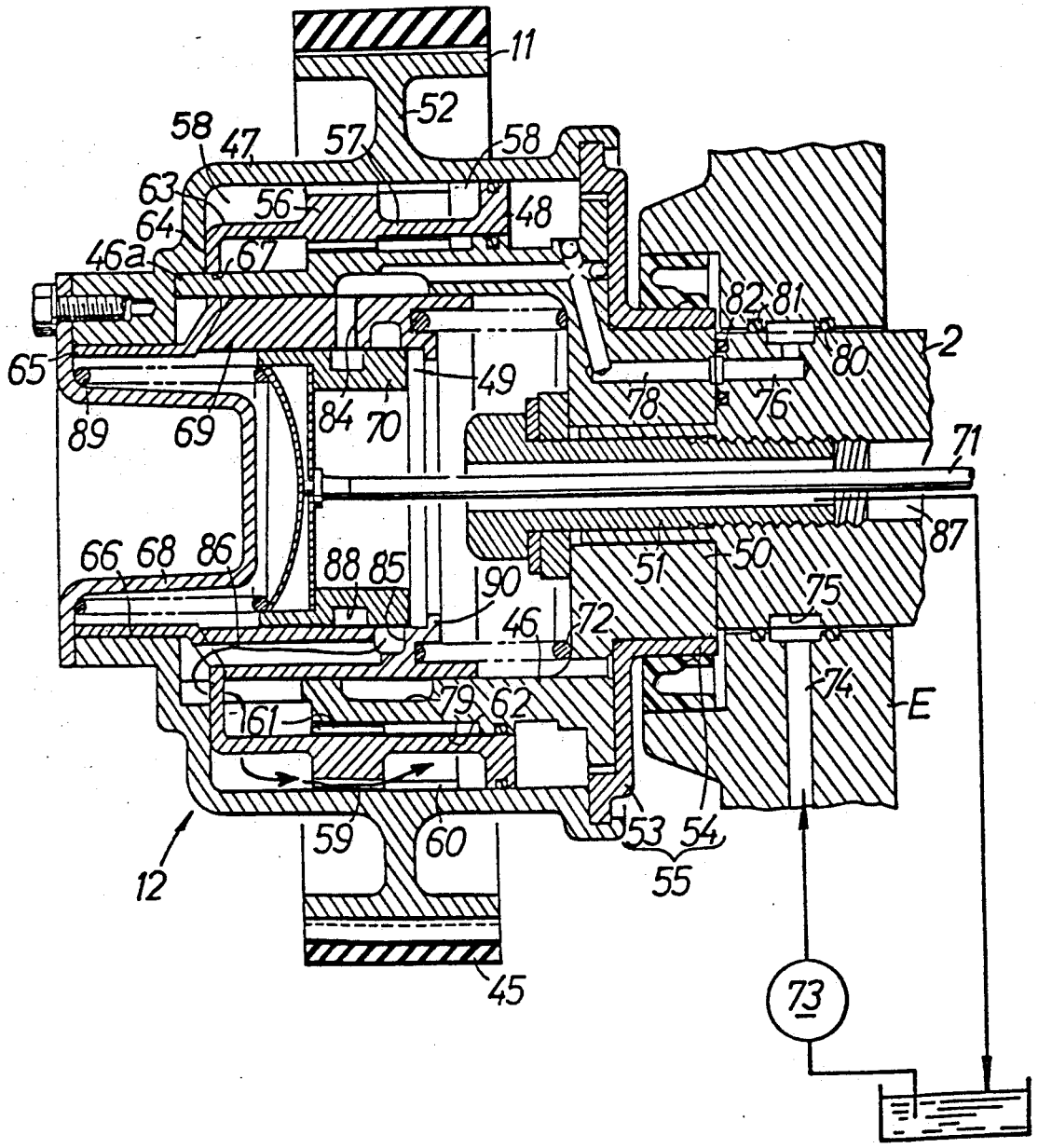
FIG. 5 is an enlarged sectional elevational view of a phase adjusting mechanism according to the present invention.

As shown in FIG. 5, the phase adjusting mechanism 12 comprises a rotatable shaft 46 coupled coaxially to the camshaft 2, and a housing 47 coaxially surrounding the rotatable shaft 46 and integral with the pulley 11 around which a timing belt 45 is trained for transmitting power from the crankshaft. A piston 48 is slidably fitted concentrically between the rotatable shaft 46 and the housing 47, and a servovalve 49 is provided in the apparatus for limiting the amount of movement of the piston 48.

The rotatable shaft 46 is in the form of a hollow, bottomed cylinder with a shaft portion 50 on its closed end. The shaft portion 50 is fixed coaxially to an end of the camshaft 2 by means of a bolt 51 extending coaxially through the closed end of the shaft 46 threadedly into the camshaft 2. The housing 47 is also in the form of a hollow, bottomed cylinder which is open toward the camshaft 2. The pulley 11 is disposed on the distal ends of a plurality of arms 52 projecting from the outer peripheral surface of the housing 47. A cap 55 has an outer peripheral edge fitted in the open end of the housing 47, the cap 55 comprising an end plate 53 held slidably against the outer surface of the closed end of the rotatable shaft 46 and a cylindrical portion 54 held slidably against the outer peripheral surface of the shaft portion 50. The rotatable shaft 46 has a distal end slidably contacting the inner peripheral surface of the closed end of the housing 47. Therefore, the housing 47 and the pulley 11 are prevented from axially moving with respect to the shaft 46 and the camshaft 2, but are allowed to rotate about the axis of the shaft 46 and the camshaft 2.

The piston 48 is of a ring shape having an outer peripheral surface held in slidable contact with the inner peripheral surface of the housing 47 and an inner peripheral surface held in slidable contact with the outer peripheral surface of the rotatable shaft 46. A ring-shaped meshing portion 56 is disposed in axially spaced relation to the piston 48. The inner edges of the piston 48 and the meshing portion 56 are interconnected by a connecting cylinder 57 surrounding the rotatable shaft 46 coaxially. The piston 48, the meshing portion 56, the connecting cylinder 57, and the housing 47 jointly define therebetween a hydraulic chamber 58 for generating a hydraulic pressure to press the piston 48 axially in one direction, to the right as shown.

The meshing portion 56 has helical outer teeth 59 on its outer peripheral surface which are held in mesh with helical inner teeth 60 on the inner peripheral surface of the housing 47. The meshing portion 56 also has helical inner teeth 61 on its inner peripheral surface which are held in mesh with helical outer teeth on the outer peripheral surface of the rotatable shaft 46. Therefore, when the piston 48 is axially moved, the housing 47 and hence the pulley 11, and the rotatable shaft 46 and hence the camshaft 2 are relatively angularly moved about their axis.

The meshing portion 56 is integral at its inner edge with a first cylindrical portion 63 extending away from the connecting cylinder 57. The first cylindrical portion 63 has a flange 64 on its distal end which extends radially inwardly and is engageable with the closed end of the housing 47. A second cylindrical portion 65 is integrally connected to the inner edge of the flange 64 and slidably fitted in a through hole 66 defined centrally in the closed end of the housing 47. Axial movement of the piston 48 in the other direction (to the left in FIG. 5) is limited by abutment of the flange 64 against the housing 47. The flange 64 has a plurality of slots 67 curved in its circumferential direction. The rotatable shaft 46 has a plurality of abutting projections 46*a* projecting integrally from its distal end for abutting against the closed end of the housing 47. The piston 48 is angularly movable with respect to the rotatable shaft 46 in a range defined between the opposite ends of the slots 67 engageable by the abutting projections 46*a*. A hat-shaped cap 68 fixed to the housing 47 enters the housing 47 in closing relation to the through hole 66.

The servovalve 49 comprises a cylindrical sleeve 69 slidably fitted in the shaft 46 and a cylindrical spool 70 slidably fitted in the sleeve 69. A control shaft 71 extending coaxially through the camshaft 2 and the shaft 46 is coupled to the spool 70. A return spring 72 is disposed between one end of the sleeve 69 and the closed end of the shaft 46 for normally urging the sleeve 69 in an axial direction to hold the other end of the sleeve 69 against the flange 64. Therefore, the piston 48 is also urged by the spring 72 axially in the other direction against the hydraulic pressure in the hydraulic chamber 58.

The engine body E has a first hydraulic pressure supply passage 74 defined therein in communication with a hydraulic pressure pump 73. The camshaft 2 has an annular groove 75 defined in an outer peripheral surface thereof and communicating with the first hydraulic pressure supply passage 74, and also has a second hydraulic pressure supply passage 76 defined therein and communicating with the annular groove 75. The shaft 46 has a third hydraulic pressure supply passage 78 defined therein and held in communication with the second hydraulic pressure supply passage 76 at all times. The shaft 46 also has an annular groove 79 defined in an inner peripheral surface thereof and communicating with the third hydraulic pressure supply passage 78. A pair of annular seal members 80, 81 is interposed between the camshaft 2 and the engine body E in sandwiching relation to the annular groove 75. Another pair of annular seal members 82 is interposed between the camshaft 2 and the shaft 46 for keeping the second and third hydraulic pressure supply passages 76, 78 in communication with each other.

The sleeve 69 has an oil hole 84 defined radially therethrough which is held in communication with the annular groove 79 at all times irrespective of the axial position of the sleeve 69 with respect to the shaft 6. The sleeve 69 also has an annular groove 85 defined in an inner peripheral surface thereof at a position adjacent to the open end of the oil hole 84 on the one side thereof (right-hand side in FIG. 5) closer to the camshaft 2. The sleeve 69 and the flange 64 held against the sleeve 69 have an oil passage 86 defined therein through which the annular groove 85 communicates with the hydraulic chamber 58. The closed end of the shaft 46 and the end plate 53 of the cap 55 have a pressure release passage 87 defined axially therethrough.

An annular groove 88 is defined in an outer peripheral surface of the spool 70 and has an axial width selected such that it can provide fluid communication between the oil hole 84 and the annular groove 85. The spool 70 is axially movable between three positions, i.e., a cutoff position in which only the oil hole 84 communicates with the annular groove 88, a supply position in which the oil hole 84 and the annular groove 85 communicate with each other through the annular groove 88 after the spool 70 has axially moved from the cutoff position in one direction relatively to the sleeve 69, and a release position in which the annular groove 85 communicates with the pressure release passage 87 after the spool 70 has axially moved from the cutoff position in the other direction relatively the sleeve 69. A spring 89 is interposed between the cap 68 and the spool 70 for normally urging the spool 70 axially in the other direction. The sleeve 69 has a stopper 90 extending radially inwardly from an axial end thereof for abutting against the spool 70 to limit relative axial movement of the sleeve 69 and the spool 70.

Operation of the embodiment will be described below. First, the phase adjusting mechanism 12 is operated by axially moving the control shaft 71 to displace the spool 70 axially in one direction from the illustrated cutoff position, i.e., to displace the spool 70 axially in one direction from the illustrated position with respect to the sleeve 69, the spool 70 reaches the supply position in which the oil hole 84 and the annular groove 85 communicate with each other through the annular groove 88. Hydraulic pressure from the pump 73 is supplied to the hydraulic chamber 58 to push the piston 48 axially in one direction against the force of the return spring 72. In response to the movement of the piston 48 axially in one direction, the housing 47 and hence the pulley, and the rotatable shaft 46 and the camshaft 2 are relatively angularly moved to advance, for example, the timing at which the intake valve 1 is opened and closed. In response to the axial movement of the piston 48, the sleeve 69 is also axially moved in one direction so that the spool 70 is axially moved in the other direction relatively to the sleeve 69 into the cutoff position. Therefore, the amount of movement of the piston 48 is determined by the amount of axial movement of the spool 70, and the amount by which the valve timing is advanced can continuously be controlled dependent on the amount of movement of the spool 70.

When the control shaft 71 is axially moved in the opposite direction to move the spool 70 relatively axially in the opposite direction, the spool 70 reaches the release position in which the annular groove 85 communicates with the pressure release passage 87, thus releasing the hydraulic pressure from the hydraulic chamber 58. The piston 48 is moved axially in the opposite direction under the force of the spring 72 to turn the pulley 11 and the camshaft 5 relatively to each other in the direction opposite to the aforesaid direction, whereupon the timing at which the intake valve 1 is opened and closed is retarded. Since the sleeve 69 is moved axially in the opposite direction with the piston 48 and the spool 70 is moved axially in said one direction relatively to the sleeve 69, the spool 70 reaches the cutoff position with respect to the sleeve 69. Therefore, the amount by which the valve timing is retarded is determined by the amount of axial movement of the spool 70, and hence can continuously be controlled dependent on the amount of operation of the spool 70.

By thus axially moving the spool 70 with the control shaft 71, the piston 48 can be operated with the movement of the spool 70 for continuously advancing or retarding the timing at which the intake valve 1 is opened and closed.

The selective coupling mechanisms 10*a*, 10*b* can selectively connect and disconnect the rocker arms by supplying hydraulic pressure to the oil passages 34*a*, 34*b* in the rocker shaft 6 or releasing hydraulic pressure from the oil passages 34*a*, 34*b*, for thereby controlling the lift and the opening interval of the intake valve 1. More specifically, when the selective coupling mechanisms 10*a*, 10*b* are in the disconnecting position, the rocker arms 7 through 9 are swingable independently of each other. The intake valve 1 is not opened or closed since the second rocker arm 8 slidingly contacting the raised portion 3 is held at rest. When the selective coupling mechanism 10*a* is in the connecting position and the selective coupling mechanism 10*b* is in the disconnecting position, the first and second rocker arms 7, 8 are coupled to each other, so that the intake valve 1 is opened and closed at the lift and the opening interval according to the cam profile of the low-speed cam 4. When the selective coupling mechanism 10*a* is in the disconnecting position and the selective coupling mechanism 10*b* is in the connecting position, the second and third rocker arms 8, 9 are coupled to each other, so that the intake valve 1 is opened and closed at the lift and the opening interval according to the cam profile of the high-speed cam 4.

Thus, the timing at which the intake valve 1 is opened and closed is controlled by the phase adjusting mechanism 12, and the lift and the opening interval of the intake valve 1 are controlled by the selective coupling mechanisms 10*a*, 10*b*. These control modes are combined together for more accurate control of valve operation of the engine.

While the valve operating device for an intake valve has been described in the above embodiment, it should be understood that the present invention is equally applicable to a valve operating device for an exhaust valve.

It will be appreciated, moreover, that, with the present invention, as described above, the phase adjusting mechanism is disposed between the timing wheel and the camshaft for turning the timing wheel and the camshaft relatively to each other. While the lift and the opening interval of the intake or exhaust valve are controlled by the selective coupling mechanisms, the timing at which the intake or exhaust valve is opened is controlled by the phase adjusting mechanism. Valve operation of the engine can be controlled more accurately by combining these two modes of control.

It should be further understood that, although a preferred embodiment of the invention has been illustrated and described herein, changes and modifications can be made in the described arrangement without departing from the scope of the appended claims.

I claim:

1. Apparatus for altering valve operation timing in an internal combustion chamber including a valve disposed in an intake or exhaust port thereof, comprising:

a rotatable camshaft;

a plurality of cams each having a profile for imparting a desired mode of operation to said valve mounted on said camshaft for rotation therewith;

a plurality of cam followers operable in response to rotation of said cams;

a selective coupling mechanism disposed between adjacent cam followers for selectively connecting said cam followers to control the lift and opening interval of said valve according to operating conditions of said engine;

a timing wheel for coupling said camshaft to said engine for rotation in synchronism therewith; and a phase adjustment mechanism disposed between said timing wheel and said camshaft for angularly varying the position of said timing wheel with respect to said camshaft for adjusting the timing of operation of said valve, wherein the timing at which said valve is operated is controlled by said phase adjusting mechanism while the lift and opening interval thereof are controlled by said selective coupling mechanism.

2. Apparatus according to claim 1 in which each of said cams has a different cam profile for imparting different modes of operation of said valve.

3. Apparatus according to claim 2 in which said cams include a high-speed cam and a low speed cam.

4. Apparatus according to claim 3 in which one of said cams has a profile defined by an annular raised portion.

* * * * *